United States Patent [19]

Nolan

[11] Patent Number: 4,499,850

[45] Date of Patent: Feb. 19, 1985

[54] APPARATUS FOR COATING THE GLASS ENVELOPE AND PREDETERMINED PORTIONS OF THE END CAPS OF A FLUORESCENT LAMP

[76] Inventor: James D. Nolan, 623 Little Silver Point Rd., Little Silver, N.J. 07739

[21] Appl. No.: 516,654

[22] Filed: Jul. 25, 1983

Related U.S. Application Data

[60] Division of Ser. No. 404,499, Aug. 2, 1982, which is a continuation-in-part of Ser. No. 196,077, Oct. 10, 1981, abandoned, which is a continuation of Ser. No. 44,473, Jun. 1, 1979, abandoned, which is a continuation of Ser. No. 940,292, Sep. 7, 1978, abandoned, which is a continuation of Ser. No. 759,823, Jan. 17, 1977, abandoned.

[51] Int. Cl.[3] ..... H01J 61/35

[52] U.S. Cl. ..... 118/406; 118/416; 118/DIG. 5

[58] Field of Search ..... 118/DIG. 5, 666, 406, 118/416

[56] References Cited

U.S. PATENT DOCUMENTS 3,440,078 4/1969 Shareths ..... 118/504

*Primary Examiner*—John D. Smith

*Attorney, Agent, or Firm*—R. Gale Rhodes, Jr.

[57] ABSTRACT

Methods of and apparatus for coating the glass envelope and predetermined portions of the end caps of a fluorescent lamp with a coating of polymeric material including securing the end caps against displacement, subsequently, preheating the glass envelope and the predetermined portion of the end caps to a first predetermined temperature above the melting point of the polymeric material for a predetermined amount of time; subsequently, masking the electrical connecting pins and all of the end caps except the predetermined portion thereof; subsequently, exposing the glass envelope and the predetermined portion of the end caps to a fluidized bed of powder of the polymeric material for a predetermined amount of time to apply a coating of the powder to the glass envelope and to the predetermined portion of the end caps; subsequently, reheating the glass envelope and the predetermined portion of the end caps to a predetermined temperature above the melting point of the polymeric material and for a predetermined amount of time to melt and fuse the powder on the glass envelope and the predetermined portion of the end caps to form the applied powder into a substantially uniform thick coating of polymeric material and; subsequently, unmasking the pins and the end caps and unsecuring the end caps. Additionally, the glass envelope and the predetermined portion of the end caps may be cooled after reheating to a predetermined temperature and for a predetermined amount of time to quench and clarify the coating of polymeric material. Additionally, the temperature of the fluidized bed may be controlled to provide more uniform coating and pressurized air may be supplied to surround the connecting pins during coating to further prevent coating of the pins.

4 Claims, 8 Drawing Figures

APPARATUS FOR COATING THE GLASS ENVELOPE AND PREDETERMINED PORTIONS OF THE END CAPS OF A FLUORESCENT LAMP

CROSS REFERENCE TO RELATED APPLICATIONS

This is a division of application Ser. No. 404,499 filed Aug. 2, 1982, which is a continuation-in-part of application Ser. No. 196,077 filed Oct. 10, 1981 (now abandoned) which is a continuation of application Ser. No. 44,473 filed June 1, 1979 (now abandoned) which is a continuation of application Ser. No. 940,292 filed Sept. 7, 1978 (now abandoned) which is a continuation of application Ser. No. 759,823 filed Jan. 17, 1977 (now abandoned).

BACKGROUND OF THE INVENTION

This invention relates generally to methods of and apparatus for coating fluorescent lamps and, in particular, to methods of and apparatus for coating the glass envelope and a predetermined portion of the end caps of fluorescent lamps.

A fluorescent lamp includes, inter alia, and insofar as pertinent to the present invention, a generally cylindrically shaped glass envelope and end caps provided at either end of the glass envelope and electrical connecting pins provided on the end caps, some lamps have a single pin on each end cap and other lamps have a pair of electrical connecting pins provided on each end cap.

As is known to those skilled in the fluorescent lamp art, a fluorescent lamp upon being dropped or falling from any appreciable height suffers the breakage of the glass envelope into numerous glass shards and, ofttimes, the disassociation of one or more of the end caps from the glass envelope or from the glass shards into which the envelope has broken. Such a happening is always dangerous whenever it occurs as the glass shards may injure a nearby person or a person attempting to handle the broken lamp.

As is further known to those skilled in the fluorescent lamp art and in particular to those experienced in the usage of such fluorescent lamps, for example, in grocery stores or supermarkets, pharmaceutical and food processing plants, hospitals, electronic assembly plants, refrigeration plants where food is stored, such fluorescent lamps are usually mounted quite high on a ceiling or other support and upon their being dropped inadvertently during mounting or replacement, or upon their being caused or allowed to fall by the unintended release of the mounting or supporting means, the fluorescent lamp falls and upon striking virtually any object the glass envelope shatters into thousands of glass shards which can be broadcast into the face and eyes of nearby persons and/or broadcast into foodstuffs such as produce residing on open display counters. Upon such an occurrence, great injury can result to the nearby persons and if all of the glass shards are not removed from the foodstuffs, in particular the produce, persons eating the foodstuffs such as the produce can consume the glass shards and suffer internal injuries including even death. Heretofore the only manner in which to obviate such possibilities is to completely throw away all of the foodstuffs into which the glass shards have fallen or may have potentially fallen which can result in considerable and even great undesirable economic loss.

Accordingly, there exists a great need in the fluorescent lamp art for a protective coating to prevent the above-noted broadcasting of glass shards and economic loss.

More specifically, there exists a great need in the fluorescent lamp art for a coating which may be applied to the fluorescent lamp which does not unduly diminish light emanating from the glass envelope but which upon the glass envelope being shattered will enclose the shattered glass envelope and will maintain the end caps in association with the shattered glass envelope thereby preventing any glass shards from being broadcast about as noted above.

As is further known to those skilled in the fluorescent lamp art, and with regard to those lamps provided with pairs of electrical connecting pins on each end cap and which pairs of pins are in radial alignment, the end caps on some of such lamps are adhesed to the ends of the glass envelope by a heat sensitive adhesive such as a thermoplastic adhesive, and hence upon the application of heat to the fluorescent lamp proximal to the melting point of the adhesive, the end caps tend to loosen and rotate with respect to the glass envelope thereby displacing the pairs of electrical connecting pins out of their radial alignment. Upon cooling of the lamp and readhesing of the heat sensitive adhesive, the pairs of electrical connecting pins are out of radial alignment and the fluorescent lamp is ruined.

Accordingly, there exists a further need in the fluorescent lamp art of being able to maintain the end caps and hence the pairs of electrical connecting pins in radial alignment while the fluorescent lamp and the end caps are heated to a temperature above the melting point of the heat sensitive adhesive securing the end caps to the glass envelope.

SUMMARY OF THE INVENTION

The methods and apparatus of the present invention satisfy the above-noted objects by providing a coating of polymeric material to the glass envelope and a predetermined portion of the end caps of the lamp which does not unduly diminish light emanating from the lamp but which collects the glass shards upon the glass envelope being broken and maintains the glass shards and the end caps in association within the coating thereby preventing broadcasting about of the glass shards as noted above.

The methods and apparatus of the present invention provide such a coating of polymeric material by securing the end caps and any pairs of electrical connecting pins against displacement of their radial alignment; subsequently preheating the glass envelope and at least a predetermined portion of the end caps to a first predetermined temperature above the melting point of the polymeric material for a first predetermined amount of time; subsequently, masking the pins and all of the end caps except the predetermined portion thereof; subsequently, exposing the glass envelope and the predetermined portion of the end caps to the fluidized bed of powder of said polymeric material for a predetermined amount of time to apply a coating of the powder to the glass envelope and the predetermined portion of the end caps; subsequently, reheating the glass envelope and the predetermined portion of the end caps to a second predetermined temperature above the melting point of the polymeric material and for a third predetermined amount of time to melt and fuse the powder on the glass envelope and the predetermined portion of the end caps to form the applied powder into a subsequently uniform thick coating of polymeric material; and subsequently, unmasking the electrical connecting pins and end caps and unsecuring the end caps. Additionally, subsequent to the reheating, the glass envelope and the predetermined portion of the end caps may be cooled to a predetermined temperature and for a predetermined amount of time to quench and clarify the coating of polymeric material. This may be repeated a number of times sufficient to assure that the coating of polymeric material is sufficiently thick so as to be sufficiently strong to collect the glass shards upon the glass envelope being broken and sufficiently strong to maintain the end caps in association with the glass shards to prevent the above-noted broadcasting of the glass shards.

DESCRIPTION OF THE INVENTION

Figure 1:
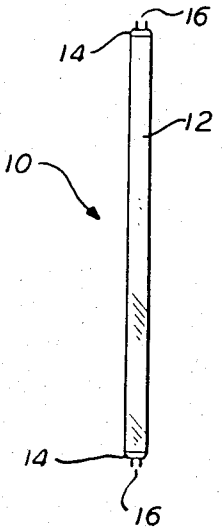
FIG. 1 is a view of a fluorescent lamp which may be provided with a coating of polymeric material according to the present invention.

Referring now to FIG. 1, there is shown a fluorescent lamp indicated by general numerical designation 10 which includes a glass envelope 12, opposed end caps 14 and electrical connecting pins provided on the end caps such as pairs of radially aligned connecting pins 16.

Figure 2:
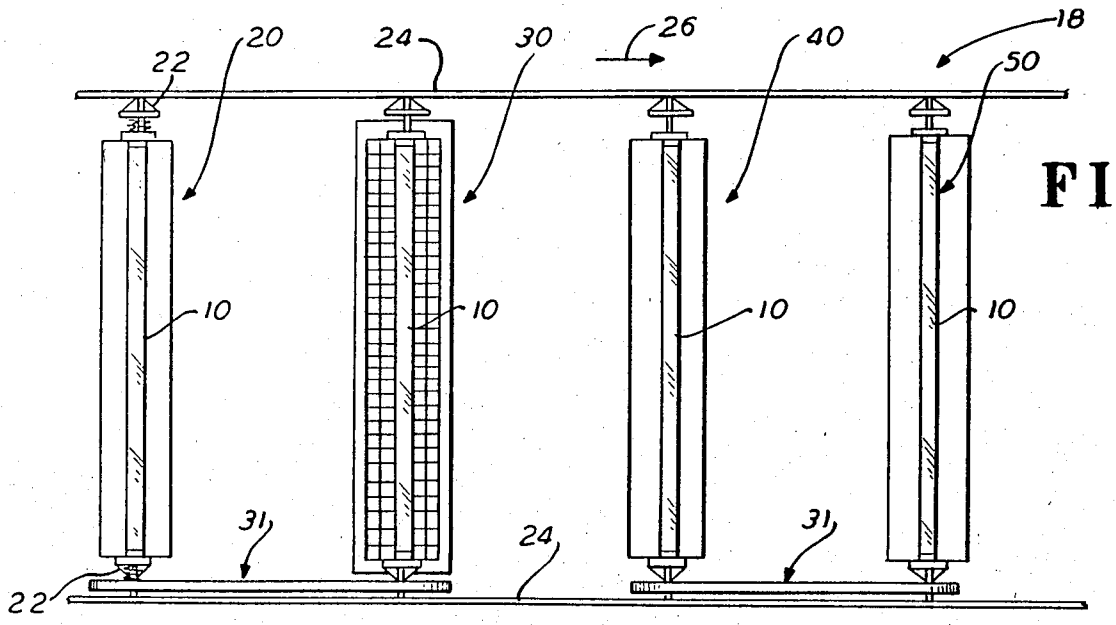
FIG. 2 is a diagrammatic figure illustrating the method of the present invention and illustrating a top view of apparatus embodying the present invention.

Referring now to FIG. 2, apparatus embodying the present invention and indicated by general numerical designation 18 is illustrated diagrammatically. Such apparatus may include four stations, namely, a preheating station 20, a fluidized bed station 30, a reheating station 40, and a cooling station 50. Further, the apparatus 18 may be comprised by suitable conveyor chains or carriers 24 spaced apart as shown in FIG. 2 and suitable means, not shown but known to those skilled in the conveyor art, for moving the conveyor chains or carriers 24 at controlled speeds with index timing whereby the fluorescent lamp 10 may be moved or indexed from station to station in the direction of the arrow 26 and wherein the fluorescent lamp may be maintained at any station for a desired or predetermined period of time. The apparatus comprising the above-noted stations may be suitably mounted for reciprocal movement upwardly and downwardly in the direction of the arrow 25 in FIG. 4, such as by being mounted on suitable pneumatically operable lift means.

Figure 4:
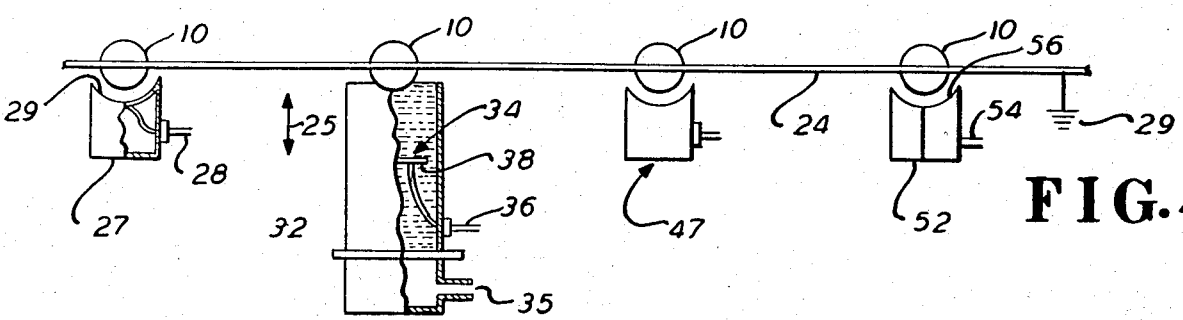
FIG. 4 is a diagrammatic illustration showing a further side view of the apparatus illustrated diagrammatically in FIG. 2.

Referring now in particular to preheating station 20 of apparatus 18, as may be best seen in FIG. 4, the preheating station 20 may include a convection heater 27 provided with an inlet port 28 for receiving a heated fluid, such as heated air, and a diffuser 29 for diffusing the heated air and directing it upwardly to heat the fluorescent lamp 10 glass envelope and end caps. Alternatively, the preheating station 20 could include a suitable radiant heater instead of the convection heater illustrated diagrammatically.

Referring now to the fluidized bed station 30, and as may be best seen in FIG. 4, the fluidized bed station may include suitable apparatus 32, known to those skilled in fluidized bed art, for producing a bed of fluidized polymeric powder indicated by general numeric designation 34. The apparatus 32 may include an inlet 35 for receiving a pressurized gas such as air from a suitable supply for the fluidization of polymeric powder received within the apparatus 32. Further, the apparatus 32 may be provided with an electrical supply inlet 36 for connection to a suitable electrostatic generator (not shown) and an electrostatic grid 38. It will be further understood by those skilled in the art that, as shown in FIG. 4, the conveyor chain or carrier 24 may be suitably grounded as indicated schematically in FIG. 4 whereby an electrostatic field may be established between the fluorescent lamp 10 and the grid 38 to assist in the applying of the powder to the lamp and end caps as taught in detail below.

Referring now to the reheating station 40, reheating station 40 is substantially the same as preheating station 20 and may include a convection heater 47 the same as convection heater 27 of reheating station 20, or, in the alternative, reheating station 40 may be provided with a suitable convection heater.

Referring now to cooling station 50, the cooling station may be provided with suitable cooling apparatus 52 including an inlet port 54 for receiving a cooled fluid, such as cooled air, and a diffuser 56 for diffusing and sending the cooled air upwardly.

Further, the apparatus 18 may include opposed pairs of combination masking and alignment elements 22—22 for engaging the opposite ends of the fluorescent lamp 10 and which combination elements may be mounted rotatably and for reciprocating movement toward and away from each other on the conveyor chains or carriers 24. More particularly, and as may be best seen in FIGS. 5 and 6, each combination masking and alignment element 22 may include a generally conical masking member 21 and an alignment member 23 provided with pairs of electrical connecting pins 16 receiving indentations 25.

It will be further understood by those skilled in the art that the combination elements 22 may be mounted on the carriers 24 for either mechanical or spring reciprocating movement toward and away from each other or for pneumatic operation. Further, it will be understood that alignment members 23—23 are mounted fixedly on the ends of reciprocably and rotatably mounted on support rods 26—26 and that masking members 21—21 are movable with respect to the rods 26—26 under the influence of the shown spring or by suitable pneumatic means not shown.

Figure 3:
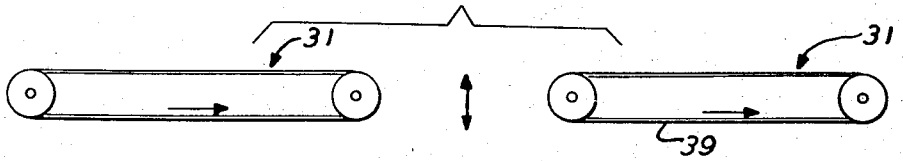
FIG. 3 is a diagrammatic illustration showing a side view of the apparatus of FIG. 2.

Rotation may be imparted to the combination masking and alignment elements 22—22 and to the fluorescent lamp 10 engaged thereby by suitable drive means indicated by general numerical designation 31, shown in FIGS. 2 and 3, which drive means may include a drive belt 39 configured as is a timing belt for suitable positive engagement with the support rods 26—26. The drive means may be suitably mounted above the conveyor chains 24—24 for reciprocable movement away from and toward and in engagement with the support rods 26—26 whereby rotation may be imparted intermittently to the fluorescent lamp 10 upon the lamp being moved into or indexed into one of the stations by the conveyor chains or carriers 24—24.

Figure 6:
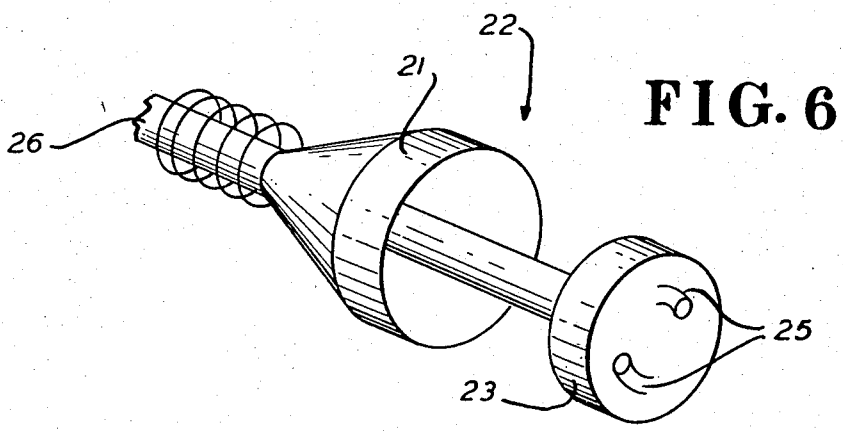

In operation of the apparatus and in the practice of the methods of the present invention, a fluorescent lamp such as fluorescent lamp 10 is positioned, manually or by suitable hopper means, between the conveyor chains or carriers 24 and opposed combination elements 22 are advanced toward each other with the alignment elements 23 engaging the opposed end caps 14 as shown and with the indentations 25 receiving the electrical connecting pins 16 but with the masking elements 21—21 withdrawn as shown in FIG. 6 leaving the major portion of the end cap exposed for pre-heating. It will be understood that the opposed alignment elements 23 are advanced toward each other with sufficient force to securely engage the opposed end caps 14 and to engage the end caps 14 with sufficient force such that when the elements 22 are rotated, such as by the drive belts 39, rotation is imparted to the fluorescent lamp 10. However, such force is insufficient to fracture or break the envelope 12. Specifically, the alignment elements 23 upon engaging the end caps 14 as shown and upon receiving the electrical connecting pins 16, further secure the end caps 14 against radial displacement with respect to the glass envelope 12 and secure the pairs of electrical connecting pins 16 in their predetermined radial alignment with respect to each other such that they will not be moved out of such radial alignment during the subsequent steps of the present invention.

Accordingly, upon fluorescent lamp 10 having its end caps engaged by the alignment elements 23, the fluorescent lamp is moved to the preheating station 20 and the envelope 12 of the fluorescent tube and the outer and peripheral portions of the end caps 14 not engaged by the alignment members 23—23 are preheated to a predetermined temperature for predetermined amounts of time by the heating apparatus 27. Upon arrival at the preheating station rotation is imparted to the lamp by the drive means 31.

Figure 5:
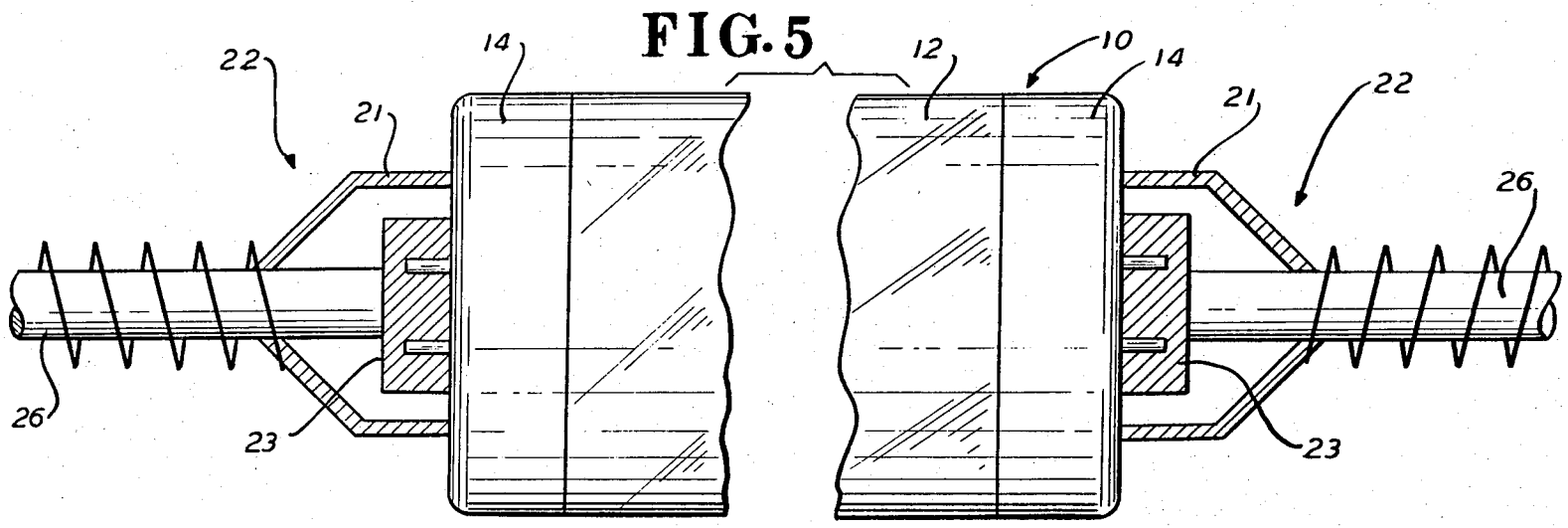
FIGS. 5 and 6 are partial figures showing schematically details of certain apparatus of the present invention and the method practiced by such apparatus.

Subsequently, the fluorescent lamp is indexed to fluidized bed station 30 and prior to such indexing or on the way from preheating station 20 to fluidized bed station 30, the masking elements 21 of the combination elements are moved toward each other into the positions shown in FIG. 5 whereby the electrical connecting pins 16 and all of the end caps 14 are masked off except the portions of the end caps not covered by the masking elements 22.

Upon the fluorescent lamp 10 arriving at the fluidized bed station 30, the fluidized bed apparatus 32 is activated, or alternatively the fluidized bed apparatus 32 may be maintained activated constantly and its function performed on the fluorescent lamp 10 during the time the fluorescent lamp 10 is present at the fluidized bed station 30. In either mode of operation, upon the fluorescent lamp 10 being present at station 30, the drive mechanism 31 is moved downwardly to engage the rod 26 and impart rotation to the fluorescent lamp 10. At the fluidized bed station 30 the fluorescent lamp envelope 12 and the portions of the end caps 14 not engaged by the masking members 21 are exposed to the fluidized bed of polymeric powder 34 and a coating of powder from the fluidized bed 34 is applied to the glass envelope 12 and the predetermined portions of the end caps 14 not covered by the masking members 21—21.

Subsequently, the drive means 31 is moved upwardly and the fluorescent lamp 10 is conveyed or indexed to the reheating station 40 by the conveyor chains or carriers 24 and during the time the fluorescent lamp 10 is present at the reheating station 40, the convection heater 47 reheats the envelope 12 and at least the portions of the end caps 14 not covered by the masking members 21 to melt and fuse the powder applied to the glass envelope 12 and the portion of the end caps 14 covered by the masking members 21 to form the applied polymeric powder into a coating of polymeric material. At station 40 the fluorescent lamp is again rotated by the drive belt 39 whereby the powder applied to the glass envelope and the end caps is reheated into a substantially uniformly thick coating of polymeric material. Subsequently, the fluorescent lamp 10 may be conveyed or indexed to the cooling station 50 which may or may not be present depending upon the type of coating to be applied and upon the clarity of coating required or desired. If present, the cooling apparatus 52 may be activated to quench and clarify the coating of polymeric material and rotation may be again imparted by the drive means 31 for even cooling. Additionally, if desired or found necessary the cooling station 50 may be employed to cool the coated fluorescent lamp such that the coated lamp may be easily, safely and readily handled by personnel.

It will be further understood by those skilled in the coating art that it has been found that, most advantageously, the fluorescent lamp may be heated at the preheating station 20 to a temperature within the range from about 150° F. to 400° F. for a period of time in the range from about 5 seconds to 4 minutes, and that the fluorescent lamp may be advantageously exposed to the fluidized bed 34 at the fluidized bed station 30 for a period of time within the range from about 5 seconds to 60 seconds and that the fluorescent lamp may be reheated at the reheating station 40 at a temperature within the range from about 255° F. to 400° F. for a period of time within a range from about 5 secconds to 4 minutes, and that at the cooling station 50, the fluorescent lamp 10 may be advantageously cooled to a temperature within the range from about 80° F. to about 100° F. for a period of time within the range from about 5 seconds to 4 minutes. Further, it has been found that a polymeric material advantageously suitable for the practice of the present invention is SURLYN, manufactured by the DuPont Company; SURLYN is a Registered Trademark of the DuPont Company.

Further, it has been found that the powder of the fluidized bed 34 may be advantageously compounded to include a suitable UV inhibitor to prevent deterioration of the coating of polymeric material due to the receipt of UV from UV sources.

Still further, it will be understood by those skilled in the art that the steps taught above for applying the coating of polymeric material to a fluorescent lamp may be repeated such that the coating will have a thickness of from about 0.018 inch to 0.040 inch, it having been found that a polymeric coating of such thickness will contain glass shards from a broken fluorescent lamp envelope and maintain the end caps in association with the glass shards upon the fluorescent lamp provided with such a coating being dropped from a height of eight feet into engagment with a ¾ inch wide board extending 12 inches high on its edge.

It will be further understood by those skilled in the art that the apparatus of the present invention may include multiple stations of each station shown or that depending upon the longest period of station operation, the apparatus may include multiple stations of one station, such as the fluidized bed station 30, which has the shortest station present period.

In brief summary, upon completion of the practice of the present invention, the fluorescent lamp 10 will be provided with a coating of polymeric material covering the glass envelope 12 and the portions of the end caps 14 not covered by the masking elements 21—21.

While the present invention was described in terms of a fluorescent lamp provided with a pair of electrical connecting pins on each end cap wherein maintaining the pins in their predetermined alignment is critical, the present invention is also useful with regard to coating fluorescent lamps having only one electrical connecting pin on each end cap wherein it is desirable to maintan the end caps in their radial positions with respect to the glass envelope and wherein the end caps must, of course, be maintained in association with the glass envelope and not be permitted to become disassociated with respect to the glass envelope.

Referring now to a further embodiment of the present invention, and as known to those skilled in the fluidized bed art, a bed, such as fluidized bed 32 of FIG. 4, produces a bed of fluidized polymeric powder by subjecting polymeric powder received within the bed to pressurized gas, such as pressurized air introduced into inlet 35 of FIG. 4. Hence, it will be understood that in the context of the fluidized bed art, the fluidized bed of powder is said to be pressurized to a predetermined level of pressurization as determined, of course, by the pressurization level of the fluidized gas to which the polymeric powder received within the bed is subjected.

It has been found that the outer end surfaces 15 of the end caps 14 of a fluorescent lamp 10 are not uniform or flat surfaces. This is due to the fact that such end caps are mass produced such as by stamping, and in performing their normally intended function, there is no requirement that the outer surfaces of such end caps be uniform, flat or lie within a single plane. However, in the practice of the present invention, such nonuniformity of end cap outer surfaces can cause sealing problems between the ends of the combination masking and aligning elements 22 (FIG. 5) and the outer surfaces 15 (FIG. 7) of the end caps 14; there are, of course, some mechanical imperfections in the typical surface-to-surface engagement between any metal parts unless their mating surfaces are machined to extremely close tolerances which is not acceptable in the present art because fluorescent lamps must be of reasonably minimal cost due to their widespread usage in extremely large volumes. Hence, it has been found that in some instances the surface-to-surface engagement of the ends of the combination masking and aligning elements 22 and the outer surfaces of the end caps 15 permit some fluidized powder to enter into the interior of the combination masking and aligning element 22 and to enter between the ends of the alignment members 22 and engage the connecting pins 16 of the fluorescent lamp 10. Since, in accordance with the practice of the present invention, the fluorescent lamp 10 is preheated before entry into the fluidized bed 32 (FIG. 4), engagement of the fluidized powder entering the masking elements 22 with the connecting pins 16 can cause unwanted and, if sufficiently extensive, ruinous coating of the connecting pins with the polymeric powder which powder upon cooling can insulate the electrical connecting pins 16 to such an extent that electric interconnection between the pins and a power source is substantially prevented and hence the fluorescent lamp cannot be illuminated.

It has been further found that since the fluorescent lamp 10 and in particular the end caps 14 are preheated before immersion in the fluidized bed 32 for coating with the polymeric powder, and that since the conical masking members 21 are at ambient or room temperature of approximately 80° F., the masking members 21, and particularly air entrapped inside thereof, upon coming into thermal contact with the preheated end caps 14, are heated towards the 400° F. and hence the entrapped air is caused to expand. Subsequently, upon the fluorescent lamp and the conical masking members 21 being immersed in the fluidized bed 32 at the lower temperature of approximately 95° F., the expanded air entrapped inside the conical masking members 21 contracts and causes at least a partial vacuum to be produced inside the conical masking members which partial vacuum can cause, or at least tend to cause, polymeric powder in the fluidized bed to be drawn into the conical masking members 21 regardless of the sealing between the conical masking members and the end caps 14; this polymeric powder then can pass between the alignment members 23 and the end caps 14 and engage and coat the electrical connecting pins which are at least somewhat heated due to the pre-heating of the fluorescent lamp, and upon cooling, this polymeric powder can coat the electrical connecting pins sufficiently to provide insulation preventing electrical contact between the connecting pins and an energy source thereby preventing the fluorescent lamp from being illuminated.

Figure 7:
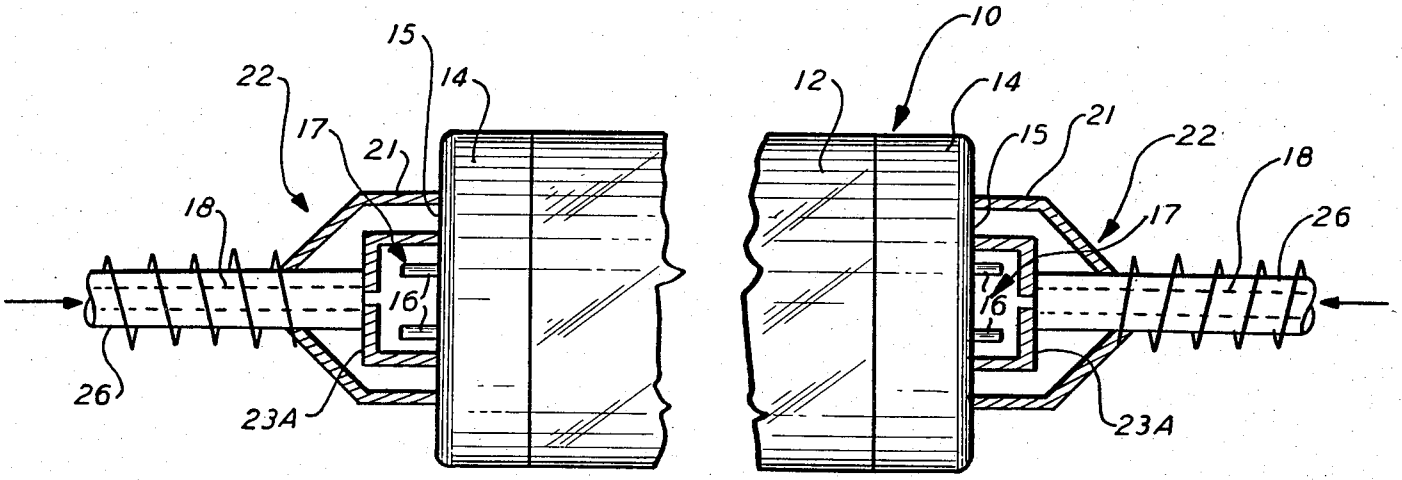
FIG. 7 is a partial view illustrating the supply of pressurized air surrounding the connecting pins during coating to prevent coating of the pins.

Accordingly, it has been found in accordance with the further teachings of the present invention that the improved method and apparatus illustrated diagrammatically in FIG. 7 further enhances the coating of only a predetermined portion of the end caps of a fluorescent lamp and, more significantly, further enhances the preventing of coating of the electrical connecting pins 16. In this improved embodiment, the alignment members 5 are replaced with the improved alignment members 23A of FIG. 7 the interior portion of which, as illustrated in cross-section in FIG. 7, is hollow thereby providing air cavities 17 surrounding the connecting pins 16 upon the alignment members 23A engaging the outer surfaces 15 of the end caps 14. As further shown in FIG. 7, the rods 26 on which the alignment members 23A are mounted are provided with internally formed, centrally axially extending, pressurized air passageways 18; the passageways 18 are suitably connected to suitable sources of pressurized air, not shown, but in the manner known to those skilled in the art. Thus, upon utilization of the alignment members 23A of FIG. 7, and upon the immersion of the pre-heated lamp into the fluidized bed 32 of FIG. 4, and upon the introduction of pressurized air pressurized to a predetermined level above the pressurization level of the fluidized bed of polymeric powder 34 into the passageway 18 and into the air cavities 17 interior of the alignment members 23A, a high pressure area is provided surrounding the connecting pins 16 and hence if any polymeric powder enters between the ends of the conical masking members 21 and the surfaces 15 of the end caps 14, such powder cannot enter the air chamber 17 because the air therein surrounding the electrical connecting pins 16 is pressurized to a predetermined level greater than the level of pressurization of the bed of fluidized polymeric powder, and hence, the connecting pins will not be coated by the polymeric powder. It has been found that by supplying pressurized air into the cavity 17, pressurized substantially 2 psi above the pressurization level in the fluidized bed 32, that coating of the connecting pins 16 is substantially eliminated even though there is some heating of the end surfaces of the end caps 14 residing within the combination masking alignment members 21 at the preheating station 20 and even though there is some entry of fluidized polymeric powder between the ends of the conical masking members 21 and the surfaces 15 of the end caps within the fluidized bed 32; in accordance with the further teachings of the present invention, and if desired, the pressurized air surrounding the pins 16 can be pressurized sufficiently above the pressurization level of the fluidized bed to cause air to be forced outwardly of the air cavities 17 between the ends of the alignment members 23A and the surfaces 15 of the end caps 14 thereby further assuring that no polymeric powder is permitted to engage and coat the electrical connecting pins 16. It will be further understood by those skilled in the art that the specific or absolute levels to which the fluidized bed 32 and the pressurized fluid in the cavity 17 are pressurized is not critical to the present invention but it is the difference in respective pressurization levels that is significant. It has been found that upon the fluid in the cavity 17 being pressurized to approximately 2 psi above the pressurization level in the fluidized bed 32, coating of the electrical pins 16 is virtually eliminated.

Figure 8:
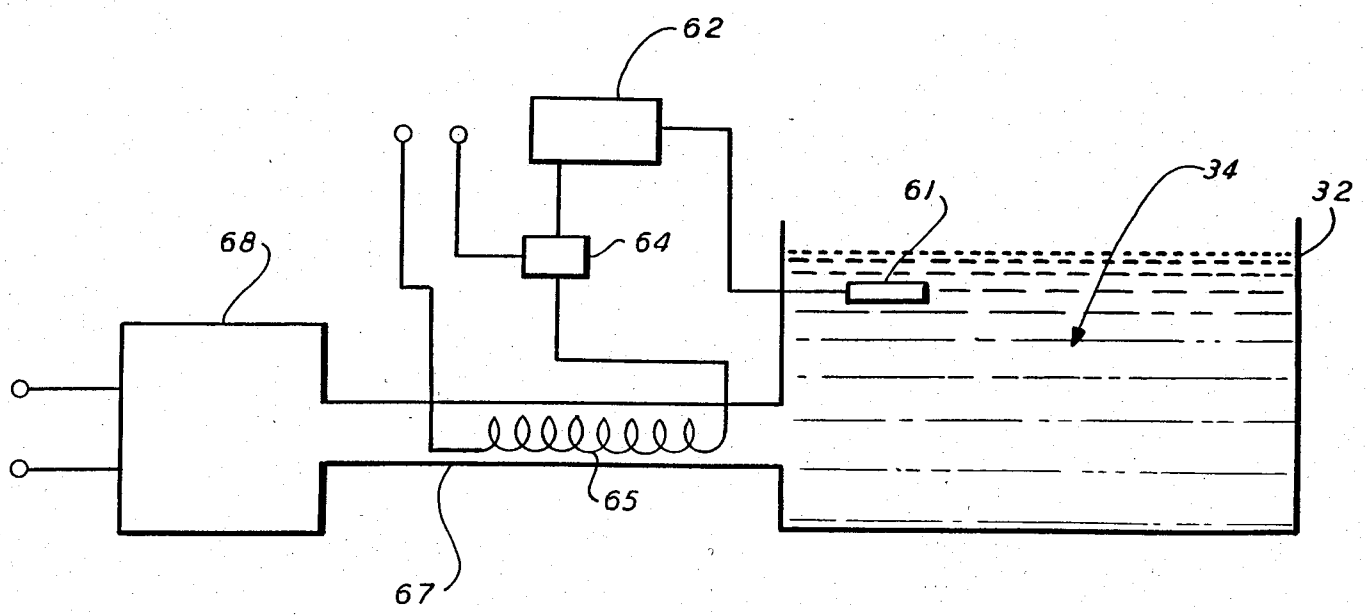
FIG. 8 is a diagrammatic illustration showing the maintenance of the fluidized bed at a predetermined temperature to enhance more uniform coating.

Referring now to FIG. 8, a further embodiment of the present invention is illustrated diagrammatically in this figure. It has been found that maintaining the temperature of the polymeric powder in the fluidized bed of polymeric powder, e.g. bed 32 of FIG. 4, at a substantially constant or uniform temperature, e.g. 95° F.±5° F., that a more uniform coating of the glass envelope of the fluorescent lamp and a predetermined portion of the end caps of the lamp can be achieved. This improvement came from the recognition that if the temperature in the fluidized bed is too warm, the polymeric powder is too heavy or too thick and will not fully and uniformly coat the glass envelope and predetermined portion of the end caps of the lamp as desired; if the temperature of the fluidized bed of polymeric powder is too cool, the polymeric powder will not adhere as desired thereby producing and undesirably thin coating with unwanted pin holes and, if too cool, the polymeric powder can even cause cracking of the glass envelope of the fluorescent lamp.

It has been found that this problem can be overcome with the improvement of the present invention illustrated in FIG. 8 by maintaining the temperature in the fluidized bed at the above-noted substantially constant or uniform temperature by the improved method and apparatus illustrated in FIG. 8. This improvement may include a thermocouple 61 for residing within and for sensing the temperature of a bed of fluidized polymeric powder indicated by general numerical designation 34 and which thermocouple is for being connected to a suitable thermostat 62 which in turn is connected to and connects or disconnects a heating coil 65 from a suitable source of electrical energy as indicated. The heating coil resides within a connecting pipe 67 interconnecting the fluidized bed 32 with a suitable blower 68 which may be any one of several known to the art. In typical operation, the blower 68 usually runs constantly and supplies pressurized fluid, for example, through the pipe 67 to the inlet 35 of the fluidized bed 32 of FIG. 4. Hence, it will be understood, that upon the suitable choice of the thermocouple 61, well within the ordinary skill of one skilled in the art, the thermostat 62 can be operated to open and close the relay 64 to energize or de-energize the heating coil 65 such that the pressurized fluid provided by the blower 68 to the fluidized bed 32 through the pipe 67 is maintained at a substantially constant or uniform temperature to provide the above-noted improved coating.

It will be still further understood by those skilled in the art that many variations and modifications may be made of the present invention without departing from the spirit and the scope thereof.

What is claimed is:

1. Apparatus for coating the glass envelope of a fluorescent lamp and a predetermined portion of the end caps of said lamp with a coating of polymeric material and wherein said lamp is provided with at least one electrical connecting pin on each end cap and wherein said end caps are secured to said glass envelope at radial positions with respect thereto, comprising:

(a) means for engaging said end caps of said lamp to secure said end caps against radial displacement with respect to said glass envelope;

(b) means for preheating said glass envelope and at least said predetermined portion of said end caps to a first predetermined temperature above the melting point of said polymeric material for a first predetermined period of time;

(c) means for rotating said fluorescent lamp during said preheating to insure uniform preheating of said glass envelope and said at least predetermined portion of said end caps;

(d) means for masking said pins and all of said end caps except said predetermined portion thereof;

(e) means providing a fluidized bed of powder of said polymeric material;

(f) said means for rotating sad fluorescent lamp for rotating said fluorescent lamp over said fluidized bed for a second predetermined period of time to apply a coating of said powder to said glass envelope and to said predetermined portion of said end caps;

(g) means for reheating said glass envelope and said at least predetermined portion of said end caps to a second predetermined temperature above said melting point of said polymeric material for a third predetermined amount of time to melt and fuse said powder applied to said glass envelope and said predetermined portion of said end caps to form said applied powder into said coating of polymeric material;

(h) said means for rotating said fluorescent lamp for rotating said fluorescent lamp during said reheating to assure that said applied powder is melted and fused into a substantially uniformly thick coating of said polymeric material; and (i) means for unmasking said end caps and said pins and for disengaging said end caps.

2. Apparatus according to claim 1 further including:

(j) means for cooling said glass envelope and said predetermined portion of said end caps of said fluorescent lamp to a third predetermined temperature and for a fourth predetermined amount of time to quench and clarify said coating of polymeric material; and (k) said means for rotating said fluorescent lamp for rotating said fluorescent lamp during said cooling to assure uniform quenching and clarification of said coating of polymeric material.

3. Apparatus for coating the glass envelope of a fluorescent lamp and a predetermined portion of the end caps of said lamp with a coating of polymeric material and wherein said lamp is provided with a pair of electrical connecting pins on each end cap thereof and wherein said pairs of electrical connecting pins are in predetermined radial alignment with each other, comprising:

(a) means for engaging said end caps of said lamp to secure said pairs of electrical connecting pins against displacement out of said predetermined radial alignment and for mounting said fluorescent lamp for rotation;

(b) means for preheating said glass envelope and at least said predetermined portion of said end caps to a first predetermined temperature above the melting point of said polymeric material for a first predetermined period of time;

(c) means for rotating said fluorescent lamp during said preheating to insure uniform preheating of said glass envelope and said at least predetermined portion of said end caps;

(d) means for masking said pins and all of said end caps except said predetermined portion thereof;

(e) means providing a fluidized bed of powder of said polymeric material;

(f) said means for rotating said fluorescent lamp for rotating said fluorescent lamp over said fluidized bed for a second predetermined period of time to apply a coating of said powder to said glass envelope and to said predetermined portion of said end caps;

(g) means for reheating said glass envelope and said at least predetermined portion of said end caps to a second predetermined temperature above said melting point of said polymeric material for a third predetermined amount of time to melt and fuse said powder applied to said glass envelope and said predetermined portion of said end caps to form said applied powder into said coating of polymeric material;

(h) said means for rotating said fluorescent lamp for rotating said fluorescent lamp during said reheating to assure that said applied powder is melted and fused into a substantially uniformly thick coating of said polymeric material; and (i) means for unmasking said end caps and said pins and for disengaging said end caps.

4. Apparatus according to claim 3 further including:

(j) means for cooling said glass envelope and said predetermined portion of said end caps of said fluorescent lamp to a third predetermined temperature and for a fourth predetermined amount of time to quench and clarify said coating of polymeric material; and (k) said means for rotating said fluorescent lamp for rotating said fluorescent lamp during said cooling to assure uniform quenching and clarification of said coating of polymeric material.

* * * * *

UNITED STATES PATENT AND TRADEMARK OFFICE

CERTIFICATE OF CORRECTION

PATENT NO. : 4,499,850

DATED : February 19, 1985

INVENTOR(S) : James D. Nolan and Axel T. Karlsson

It is certified that error appears in the above-identified patent and that said Letters Patent are hereby corrected as shown below:

On the title page, Item (76) should read as follows:

James D. Nolan
623 Little Silver Point Road
Little Silver, New Jersey 07739 and

Axel T. Karlsson
94 Townsend Drive
Middletown, N w Jersey 07748

Column 6, line 39, "255" should be --225--.

Column 6, line 40, "secconds" should be --seconds--.

Column 9, line 47, "and" should be --an--.

Column 10, line 39, "sad" should be --said--.

Signed and Sealed this

*Tenth* Day of *September 1985*

[SEAL]

*Attest:*

DONALD J. QUIGG

*Attesting Officer* *Acting Commissioner of Patents and Trademarks - Designate*